US006170377B1

(12) United States Patent
Larsson et al.

(10) Patent No.: US 6,170,377 B1
(45) Date of Patent: Jan. 9, 2001

(54) METHOD AND ARRANGEMENT FOR PROGRAMMING SHELLS

(75) Inventors: Rolf Larsson; Nils Johansson; Erik Fohrman; Björn Hagström; Sven-Åke Jern, all of Karlskoga (SE)

(73) Assignee: Bofors AB, Karlskoga (SE)

( * ) Notice: Under 35 U.S.C. 154(b), the term of this patent shall be extended for 0 days.

(21) Appl. No.: 09/171,105

(22) PCT Filed: Apr. 11, 1997

(86) PCT No.: PCT/SE97/00606

§ 371 Date: Jan. 13, 1999

§ 102(e) Date: Jan. 13, 1999

(87) PCT Pub. No.: WO97/39303

PCT Pub. Date: Oct. 23, 1997

(30) Foreign Application Priority Data

Apr. 18, 1996 (SE) ..... 9601467

(51) Int. Cl.[7] ..... F42C 17/00

(52) U.S. Cl. ..... 89/6.5; 89/6; 102/265; 102/270

(58) Field of Search ..... 89/6, 6.5; 102/265, 102/270

(56) References Cited

U.S. PATENT DOCUMENTS

| | | | | |
|---|---|---|---|---|
| 4,005,631 | | 2/1977 | Kaiser et al. | 89/6.5 |
| 4,644,930 | * | 2/1987 | Mainhardt | 124/58 |
| 4,649,796 | * | 3/1987 | Schmidt | 89/6.5 |
| 4,664,013 | | 5/1987 | Wegner et al. | 89/6.5 |
| 4,711,152 | | 12/1987 | Fortunko | 89/6.5 |
| 4,979,424 | * | 12/1990 | Becker et al. | 89/6.5 |
| 5,117,732 | | 6/1992 | Munzel et al. | 89/6.5 |

FOREIGN PATENT DOCUMENTS

| | | |
|---|---|---|
| 0 118 122 A1 | 9/1984 | (EP) . |
| 0 300 255 B1 | 4/1991 | (EP) . |
| 0 467 055 B1 | 10/1993 | (EP) . |

* cited by examiner

*Primary Examiner*—Charles T. Jordan
*Assistant Examiner*—Michelle Thomson
(74) *Attorney, Agent, or Firm*—Pollock, Vande Sande & Amernick, R. L.L.P.

(57) ABSTRACT

A method for contactless inductive transmission of programming data to a programmable time fuse included in a shell for a single shot, semi-automatic, or fully automatic shell firing barrel weapon. While the shell is situated in a cartridge chamber of a barrel of the weapon, data is transmitted to the programmable time fuse from a programming device of the weapon via a transmitting coil arranged around the cartridge chamber of the barrel to a receiving coil arranged in the shell. At least a part of the barrel lying between the coils is replaced by a non-magnetic material and designed so that it does not form an electrically conductive short circuited layer that would prevent transmission between the coils.

19 Claims, 1 Drawing Sheet

METHOD AND ARRANGEMENT FOR PROGRAMMING SHELLS

FIELD OF THE INVENTION

The present invention relates to a method and to an arrangement to make it possible, in single-shot and also semi-automatic and fully automatic shell-firing barrel weapons, and particularly in those which are provided with rifled barrels made of steel, to transmit, contactlessly and inductively, relevant programming data to a programmable fuse function included in the respective shell while the shell is still situated in the cartridge chamber of the weapon.

BACKGROUND OF THE INVENTION

As far as detonating shells are concerned, the main effect of which on the target is achieved through splinter, it has been known for a long time that the effect on the target depends directly upon how close to the target the detonation takes place, and also whether this takes place above the target, which clearly produces the best effect, or on ground impact beside the target. Even though efforts are, of course, made to achieve direct strikes on the target, such direct strikes are not particularly frequent in spite of modern fire-control and missile-trajectory calculating instruments.

One way of bringing about air bursts directly above: the target aimed at is based on providing the shells with a programmable time fuse function which can be programmed for detonation at the trajectory distance from the firing point at which it is calculated that the target is situated. When using shells of this type it is desirable to carry out this programming as late as possible before firing. This is particularly the case with shell-firing infantry weapons where, with mobile positions, it may be expected that both oneself and the target are continuously moving around on the battlefield. Under these circumstances, it would therefore be a clear advantage if the time fuse function of the shells could be programmed as late as possible before firing, e.g. when the shell is ready for firing in the cartridge chamber of the shell-firing weapon.

Arranging such programming of the time fuse function of the shells inside the cartridge chamber of the weapon, however, involves certain problems because the cartridge chamber constitutes part of the barrel. However, it is heretofore known, however, that it is possible to program in an inductive manner electronic shell fuses which are designed in a special manner.

Since all shell-firing weapons, except possibly those of one-shot type, have barrels made of steel which are both electrically conductive and magnetic, inductive fuse programming was previously only possible before loading of the weapon or alternatively while the shell was being fed from a magazine to the cartridge chamber of the weapon. Furthermore, EP-A1-0300255 and EP-A1-0467055 describe proposals for how the same type of inductive programming can be carried out immediately after the shell has left the barrel. In these arrangements, it is proposed that the coil which is to supply the programming signal be placed immediately outside the mouth of the barrel so that the shell passes through it. For various reasons, these solutions have proved to be more difficult to implement in practice than was originally theoretically assumed. Then, as far as programming further away from the firing point is concerned, along the actual missile trajectory, this involves such great technical complications that, although they are by no means insurmountable, they would probably only be justified in terms of effectiveness in larger calibers such as 10.5 cm and above.

SUMMARY OF THE INVENTION

As an alternative to the previously used variants indicated above, both a new method and a new arrangement are now proposed according to the present invention for inductive programming directly in the cartridge chamber of the programmable time fuses for the shells of shell-firing barrel weapons intended for both single-shot and also for semi-automatic and fully automatic firing.

The invention is based on the fact that the part of the material in the barrel of the weapon which constitutes the cartridge chamber of the weapon is replaced by a non-magnetic insert around which one or more coils for inductive programming of the time fuse of the shells are wound. However, the problems are not completely solved by this arrangement alone. This is because a further prerequisite for it to be possible for the inductive programming of the time fuses to function is that this non-magnetic insert is not electrically conductive either. If it were electrically conductive, it would form a short-circuited layer which would prevent the programming signal from being transmitted to the time fuse of the shell. It would be possible to satisfy both these conditions immediately if the insert could be made of a material which was not magnetic and had such poor electric conductivity that it was of the type usually referred to as electrically non-conductive material. Since it must also be taken into account that the material in the insert must withstand the high temperature and the high pressure which occur in the barrel on firing, the number of possible materials is very limited. One group of materials which are both non-magnetic and electrically non-conductive and are known to be hard, hard-wearing and heat-resistant, and therefore, would theoretically be suitable for producing cartridge chamber inserts of the type in question, are the so-called ceramic metals. As a rule, however, these materials are brittle. Thus it would be difficult today to produce entire cartridge chamber inserts of the type in question from such ceramic metals.

According to a preferred development of the invention, it is therefore proposed that the cartridge chamber inserts themselves are made of a non-magnetic metal with sufficiently high hardness and heat resistance such as e.g. niobium or stainless steel, a direct short-circuiting of the surrounding coils being prevented by providing the insert with a gap in the longitudinal direction of the barrel. Electric insulation of the gap can in this connection advantageously be constituted by a suitable ceramic metal.

If the insert is made of stainless steel for example, there is nothing to prevent the barrel rifling being continued into the insert. This presupposes, however, that the insert is fastened non-rotatably in the barrel.

The invention has been defined in its entirety in the following patent claims and at the same time will now be described in somewhat greater detail in conjunction with the attached figures.

The invention has here been illustrated in a variant conceived for use on a so-called shell sprayer. As this type of weapon is generally known and exists in a number of variants with mechanically similar operation, only components essential for the invention have been included in the figures, in which

BRIEF DESCRIPTION OF THE FIGURES

FIG. 2 shows the same longitudinal section but with a shell rammed home in the cartridge chamber (the shell itself is sectioned only in the part which is significant for understanding the invention), while

DETAILED DESCRIPTION OF THE DRAWINGS

Figure 1:
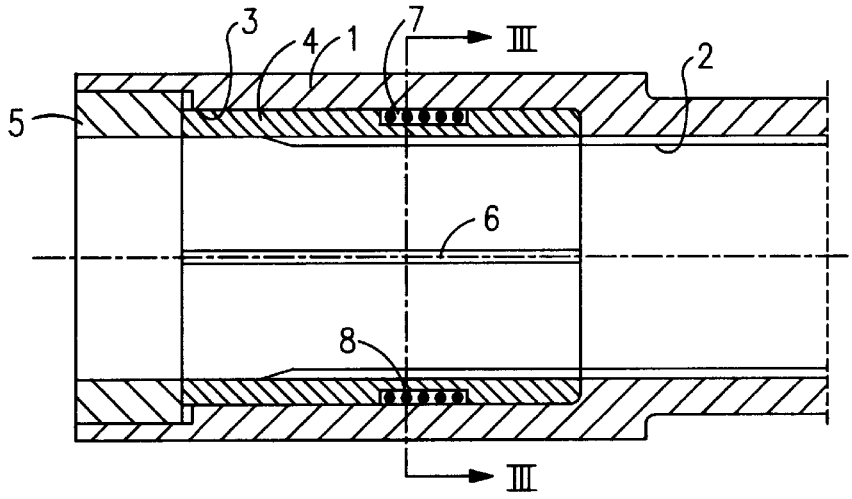
FIG. 1 shows a longitudinal section through the part of the barrel which constitutes the cartridge chamber of the weapon.

The barrel 1 shown in the figures is provided with a rifling 2 indicated internally. In the rear part of the barrel, there is a bore 3 in which, on the one hand, a front insert 4 and on the other hand a rear fastening ring 5 are inserted. The front insert 4 can be shrink-fitted or locked with wedges while the rear fastening 5 is shrink-fitted securely. The insert 4 is provided with a gap 6 filled with a ceramic metal which is an electrically non-conductive material. Running around the insert 4 is at least one external groove 7 in which at least one induction coil 8 is arranged. The coil(s) 8 is (are) connected by means of the cables 9 and 10 to a programming device 11 which can be set to transmit optional range/time programming to the shell.

Figure 2:
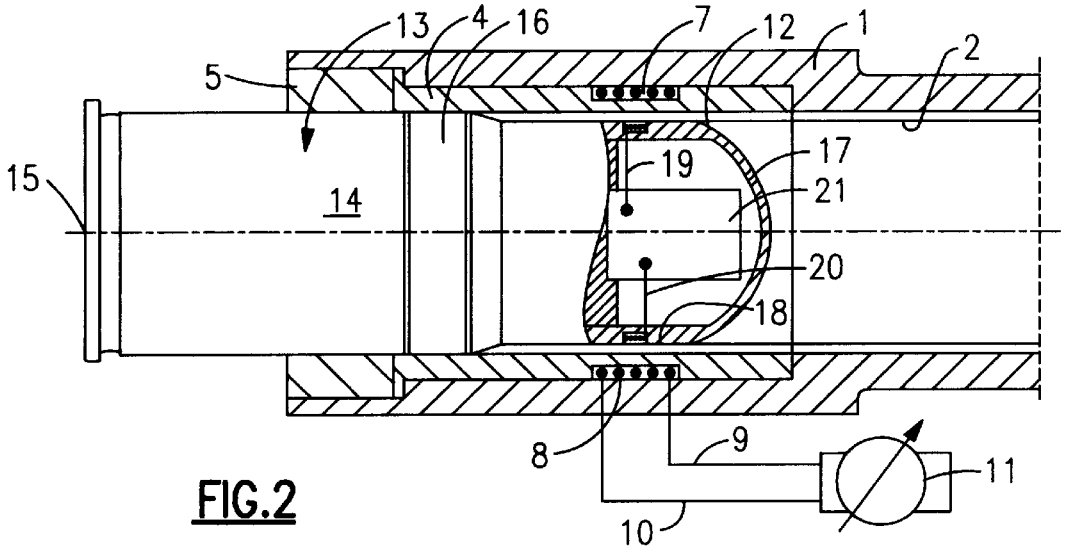
Figure 3:
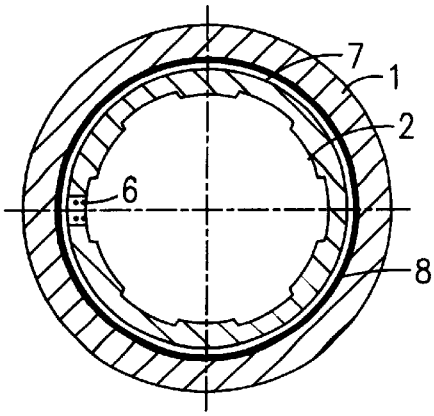
FIG. 3 shows the section III—III in FIG. 1.

The shell 12 in question is shown in FIG. 2 as a part of the complete charge 13. The latter also includes the cartridge case 14, filled with propellant, with a rear percussion cap 15. The thrust band 16 of the shell can also be seen in the figure. In the figure, the shell is shown in its rammed-home position in the cartridge chamber of the barrel 1.

Components in the front sectioned part of the shell which are significant in connection with the invention include its front cover or cap 17 made of plastic. Embedded in the material of the cap is a receiving coil 18 which is electrically connected to the electronic time fuse function 21 of the shell by the cables 19 and 20.

With the arrangement shown in the figure, time programming set in the electronic programming device 11 can be transmitted inductively via the coil 8 to the coil 18 which in turn conveys this information on to the time fuse function 21. With the aid of this arrangement, the shell 12 can always be programmed very close to or during the introductory firing phase.

What is claimed is:

1. A method for contactless inductive transmission of programming data to a programmable time fuse included in a shell for a single shot, semi-automatic, or fully automatic shell firing barrel weapon, the method comprising:

while the shell is situated in a cartridge chamber of a barrel of the weapon transmitting data to the programmable time fuse from a programming device of the weapon via a transmitting coil arranged around the cartridge chamber of the barrel to a receiving coil arranged in the shell, at least a part of the barrel lying between the coils being replaced by a non-magnetic material and designed so that it does not form an electrically conductive short circuited layer that would prevent transmission between the coils.

2. The method according to claim 1, wherein the weapon comprises a rifled barrel made of steel.

3. The method according to claim 1, wherein the time fuse of the shell is time-programmed to detonate after a given trajectory length.

4. An arrangement for contactless inductive transmission of programming data to a programmable time fuse included in a shell for a single shot, semi-automatic, or fully automatic shell firing barrel weapon while the shell is situated in a cartridge chamber of the barrel, the arrangement comprising:

an insert arranged in the barrel of the weapon so as to surround at least a part of the cartridge chamber that is occupied by the shell, the insert comprising non-magnetic material; and at least one electromagnetic coil wound around the insert for inductive transmission of programming data to the time fuse, the insert being designed in such a manner that it does not form an electrically conductive short circuited layer.

5. The arrangement according to claim 4, wherein the weapon comprises a rifled barrel made of steel.

6. The arrangement according to claim 5, further comprising:

at least one gap transversely dividing the insert in a winding direction of the at least one electromagnetic coil; and an electrically insulating material that fills the at least one gap.

7. The arrangement according to claim 6, wherein the electrically insulating material comprises a ceramic metal.

8. The arrangement according to claim 4, wherein the insert comprises a nonmagnetic metal.

9. The arrangement according to claim 8, wherein the nonmagnetic metal is selected from the group consisting of stainless steel and niobium.

10. The arrangement according to claim 8, further comprising:

at least one gap transversely dividing the insert in a winding direction of the at least one electromagnetic coil; and an electrically insulating material that fills the at least one gap.

11. The arrangement according to claim 10, wherein the electrically insulating material comprises a ceramic metal.

12. The arrangement according to claim 10, further comprising:

at least one gap transversely dividing the insert in a winding direction of the at least one electromagnetic coil; and an electrically insulating material that fills the at least one gap.

13. The arrangement according to claim 12, wherein the electrically insulating material comprises a ceramic metal.

14. The arrangement according to claim 4, further comprising:

at least one gap transversely dividing the insert in a winding direction of the at least one electromagnetic coil; and an electrically insulating material that fills the at least one gap.

15. The arrangement according to claim 14, wherein the electrically insulating material comprises a ceramic metal.

16. The arrangement according to claim 14, wherein the insert is non-rotatably and non-displaceably fastened in the barrel by fastening means.

17. The arrangement according to claim 16, wherein the insert is fastened by one of shrink-fitting and wedges.

18. The arrangement according to claim 4, wherein the insert is non-rotatably and non-displaceably fastened in the barrel by fastening means.

19. The arrangement according to claim 18, wherein the insert is fastened by one of shrink-fitting and wedges.

* * * * *